US005134869A

United States Patent [19]

Gable

[11] Patent Number: 5,134,869

[45] Date of Patent: Aug. 4, 1992

[54] KEYSAFE RESETTING MECHANISM

[75] Inventor: Derek J. Gable, Rancho Palos Verdes, Calif.

[73] Assignee: Multacc Corporation, Torrance, Calif.

[21] Appl. No.: 579,593

[22] Filed: Sep. 10, 1990

[51] Int. Cl.[5] ..... E05B 37/00

[52] U.S. Cl. ..... 70/63; 70/284; 70/433

[58] Field of Search ..... 70/63, 284, 285, 311, 70/433

[56] References Cited

U.S. PATENT DOCUMENTS

| | | | |
|---|---|---|---|
| 1,937,523 | 12/1933 | Machinist | 70/284 |
| 3,416,337 | 12/1968 | Hutchins | 70/284 |
| 3,529,455 | 9/1970 | Hartzell | 70/433 X |
| 4,325,240 | 4/1982 | Gable | 70/63 X |
| 4,455,847 | 6/1984 | Hung | 70/284 |
| 4,532,783 | 8/1985 | Maurice | 70/63 |
| 4,671,088 | 6/1987 | Jeang | 70/284 X |
| 4,770,013 | 9/1988 | Nakai | 70/285 |
| 4,838,052 | 6/1989 | Williams et al. | 70/63 |
| 4,947,163 | 8/1990 | Henderson et al. | 70/63 X |
| 4,967,576 | 11/1990 | Warfman | 70/63 |

*Primary Examiner*—Richard E. Moore
*Assistant Examiner*—Suzanne L. Dino
*Attorney, Agent, or Firm*—Allen A. Dicke, Jr.

[57] ABSTRACT

A keysafe has tumblers which are set by a key-like programmer and has combination wheels which, when correctly set, have slots which receive the set tumblers. Thus, there is a unique combination for each programmer. In order to reset the combination wheels to their beginning, reference position, a slot is provided in each combination wheel, together with a lock bar which can enter the slot when the combination wheels are in the reference position. This lock bar is actuated to permit the programmer to be withdrawn.

20 Claims, 2 Drawing Sheets

KEYSAFE RESETTING MECHANISM

FIELD OF THE INVENTION

This invention is directed to a mechanism for resetting the combination wheels in a keysafe having two inputs.

BACKGROUND OF THE INVENTION

Derek J. Gable U.S. Pat. No. 4,325,240 disclosed a locking mechanism particularly useful in keysafes and similar devices wherein two correct and related inputs are necessary for opening of the mechanism. Preferably, the two inputs are a programmer and a combination lock with a plurality of combination wheels. The structure is arranged so that, when a programmer is inserted, the internal lock mechanism is set in a unique position so that a unique setting of the combination wheels is necessary for opening the lock.

When the keysafe has been opened and subsequently closed, it is preferable to reset the combination wheels to a reference position. Quite often, this reference position is an all ones position. It is, thus, desirable to have a mechanism for requiring that each combination wheel be reset to one.

SUMMARY OF THE INVENTION

In order to aid in the understanding of this invention, it can be stated in essentially summary form that it is directed to a keysafe resetting mechanism wherein the combination wheels have a slot therein and a lock bar can enter the slots when the combination wheels are in their reference position. This lock bar is actuated by the programmer so that the programmer can only be removed when the combination wheels are in their reference position.

It is, thus, an object and advantage of this invention to provide a keysafe resetting mechanism which requires that the combination wheels be reset to the reference position upon closing and locking of the mechanism.

It is a further object and advantage of this invention to provide a keysafe which has two inputs, one a programmer and the other a series of combination wheels, and an interengaging mechanism so that the combination wheels are reset into reference position before the programmer is permitted to be withdrawn.

It is a further object and advantage of this invention to provide an inexpensive and reliable keysafe with a resetting mechanism which requires the user to perform the necessary steps in the correct sequence in order to unlock and relock the keysafe, including resetting of the combination wheels and withdrawal of the programmer.

Other objects and advantages of this invention will become apparent from a study of the following portion of the specification, the claims and the attached drawings.

DESCRIPTION OF THE PREFERRED EMBODIMENT

Figure 1:
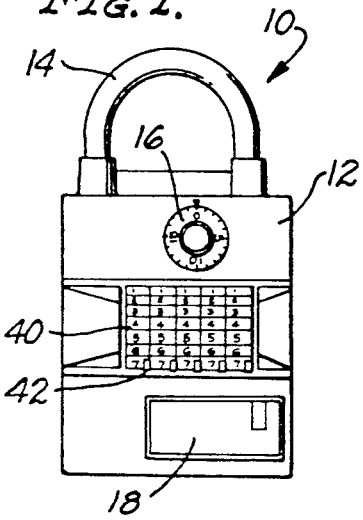
FIG. 1 is a front elevational view of a keysafe having the resetting mechanism of this invention.
Figure 2:
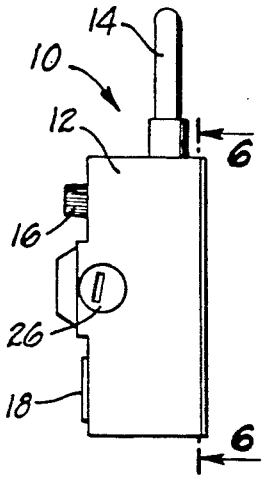
FIG. 2 is a side elevational view thereof.
Figure 3:
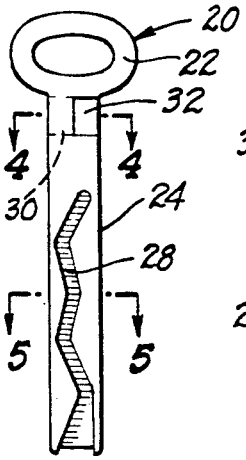
FIG. 3 is an enlarged side view of an example of the programmer.
Figure 4:
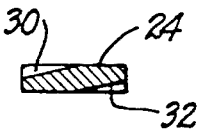
FIG. 4 is an enlarged section through the programmer, as seen generally along 4—4 of FIG. 3.
Figure 5:
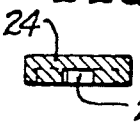
FIG. 5 is a view similar to FIG. 4, as seen generally along line 5—5 of FIG. 3.

The keysafe of this invention is generally indicated at 10 in FIGS. 1 and 2. The keysafe has a lock body 12 which has a hasp 14 thereon. The hasp is engaged around any convenient strong part in order to keep the keysafe 10 in its selected location. Combination lock 16 is for releasably locking the hasp 14. The body 12 has a drawer 18 which is sized to receive a key or other security device. The purpose of the keysafe is to securely retain that key or other entry device and permit access thereto only to qualified persons.

To operate the keysafe and release the drawer 18, two inputs are required. Programmer 20, shown in FIGS. 3, 4, 5 and 10, has a handle 22 and shank 24. The handle permits manual manipulation and control of the programmer. The cross-section of the shank is such as to permit it to be introduced into the lock cylinder 26. While an irregular cross-section may be useful, in the present instance, the cross-sectional outline of the programmer shank is rectangular. The shank carries cam groove 28 which receives pins to position the lock tumblers, as is described herebelow. The front end of the cam groove is funnel-shaped to collect the tumbler pins upon entry. In addition, the shank has beveled notches 30 and 32 at its handle end for operational reasons described below.

Figure 10:
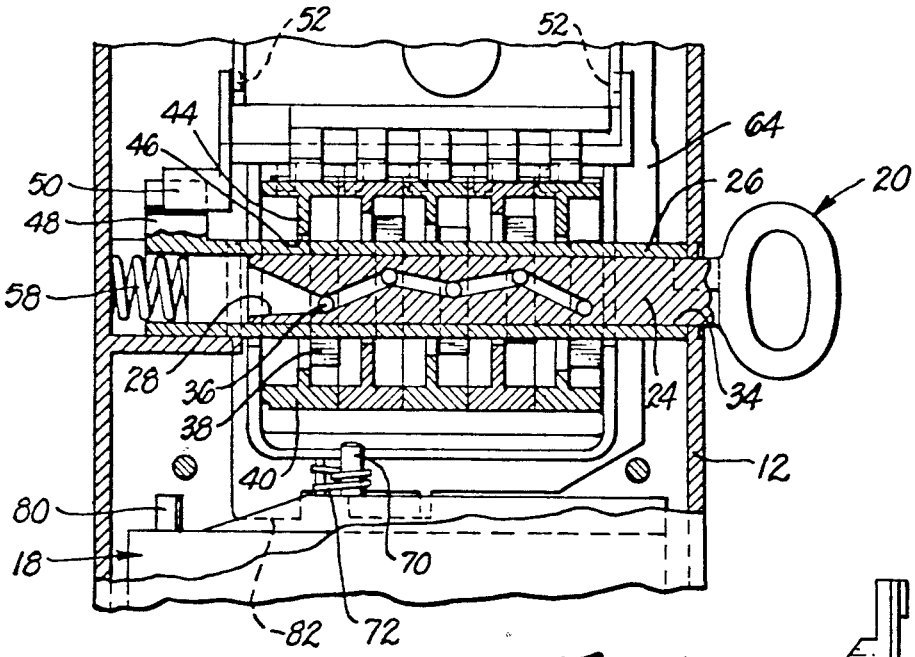
FIG. 10 is an enlarged view taken generally along line 10—10 of FIG. 7, with parts broken away.

When programmer 20 is introduced into lock cylinder 26, it meets a series of pins which extend into the programmer slot in the lock cylinder. The programmer slot 34 is indicated in FIG. 10, and the five tumbler pins are shown in the cam groove 28. For convenience, only tumbler pin 36 is numerically indicated and is shown as being carried on tumbler 38. Each of the other pins has a corresponding tumbler. When the programmer is inserted, the tumblers are moved to the position dictated by the programmer cam groove 28.

There are five combination wheels corresponding in number to the tumblers. Combination wheel 40 is illustrative of the five combination wheels and is seen in FIGS. 1, 7, 10 and 11. Each of the combination wheels is rotatable around the lock cylinder 26 to a plurality of discrete positions. In the present instance, the number of discrete positions is limited to a partial revolution of each of the wheels. Each of the combination wheels is separately rotatable. As seen in FIG. 1, there are seven discrete indicia on each of the combination wheels from 1 through 7. When all of the combination wheels are aligned with the numeral 1 at the top, this is considered the reference position. In order to control and limit the rotation of the combination wheels, each has a finger engageable actuator thereon. Actuator 42 is indicated for combination wheel 40. Each of the combination wheels has a web therein, with web 44 indicated in combination wheel 40 in FIG. 10. Each web lies to the left of its corresponding tumbler when the keysafe is in its locked condition. Each of the webs has a radial opening corresponding to the length of the associated tumbler and positioned radially in the web in alignment with the tumbler when the programmer 20 is in position and the combination wheel is turned to its unique position for that programmer. Slot 46 is shown in web 44 in alignment with tumbler 38. It is seen that the various slots have different radial positions, as desired, and different rotational positions in the combination wheel as compared to the indicia and starting reference position thereof. Thus, for each programmer, there is a unique combination wheel setting which is unique to that programmer and which brings the slots in the webs (for example, slot 46 in web 44) in line with their corresponding tumblers.

Figure 12:
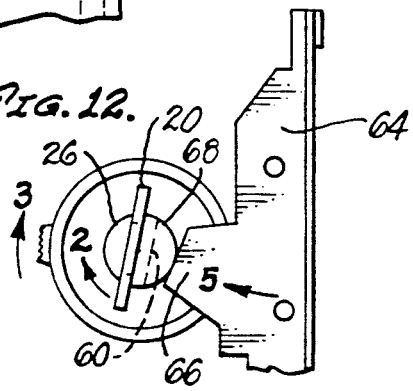
FIG. 12 is a diagrammatic view of the lock from the programmer end schematically showing some of the structure and indicating the sequence of actuation.
Figure 13:
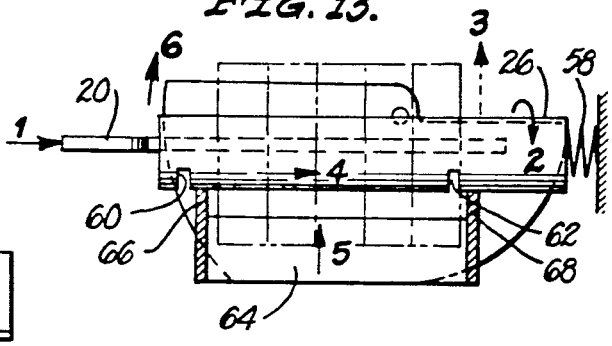
FIG. 13 is a schematic drawing of some of the parts of the lock looking downward from the lock cylinder showing some of the parts diagrammatically to indicate the sequence of operation in the opening of the lock.

Referring to FIG. 13, the numeral "1" thereon indicates that the first step of the operation is to insert the programmer 20. At this point, the combination wheels are not yet set. The next step is that shown by arrow "2" in FIGS. 12 and 13 wherein the programmer and cylinder are rotated clockwise. This is permitted by the beveled notches 30 and 32 when the programmer is fully installed. The beveled notches prevent withdrawal of the programmer in this position.

Figure 6:
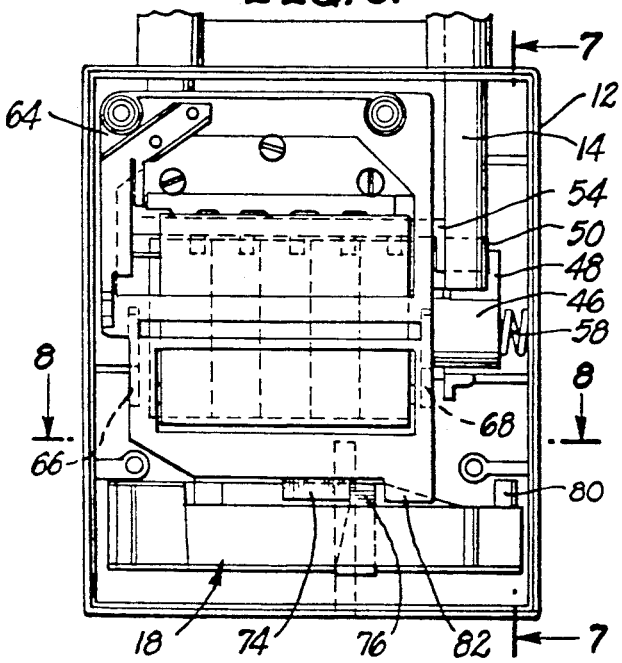
FIG. 6 is an enlarged view of the keysafe from the back, with the back cover removed, as seen generally along line 6—6 of FIG. 2.
Figure 7:
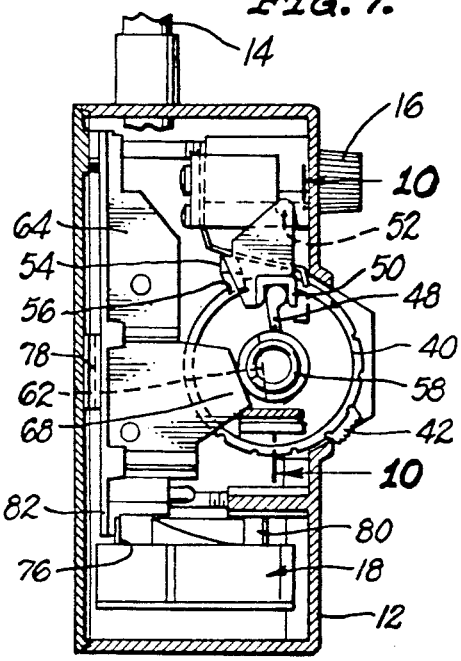
FIG. 7 is a section through the keysafe, as seen generally along line 7—7 of FIG. 6.
Figure 11:
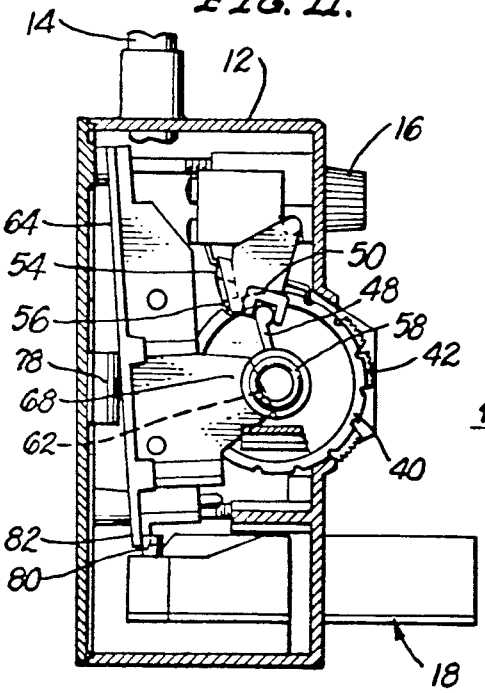
FIG. 11 is a view similar to FIG. 7, but showing the keysafe drawer in the intermediate position.

Ear 48 protrudes from the lock cylinder 26. Rotation of the lock cylinder in the clockwise direction, as seen from the right side where the programmer is inserted, causes counterclockwise rotation of the ear 48, as seen in FIGS. 7 and 11. In FIG. 7, the ear is in the unrotated position, and in FIG. 11, it is in the rotated position. Fork 50 engages ear 48 and is pivoted on pivot pin 52, see FIGS. 6, 7 and 10. Bar 54 is pivoted with fork 50. In the unrotated position in FIG. 7, bar 54 is shown as engaging in aligned slots 56 in the combination wheels. When the combination wheels are in the reference position, for example with the ones in alignment in the top row and the actuators 42 all down against the edge of the combination wheel opening, seen in FIG. 11, then the bar 54 can engage in the slots. The bar 54 cannot move from the rotated to the unrotated position; that is, from the FIG. 11 to the FIG. 7 position, without the combination wheels all being in the reference position. Rotation of the programmer in the direction of the arrow "3" seen in FIGS. 12 and 13, thus raises the bar out of the slots in the combination wheels. Next, in accordance with the arrow "3" in FIGS. 12 and 13, the combination wheels are set. At this point, the tumblers are in line with the slots in the webs, as required by the particular programmer. With the slots in the webs thus aligned with the tumblers, the lock cylinder can be thrust inward in the direction of arrow "4", see FIG. 13. The position of the lock cylinder 26 is shown in FIG. 13 before it is thrust inward. Compression spring 58 urges the lock cylinder 26 in the opposite direction. Lock cylinder 26 carries two slots 60 and 62 therein. These slots are best seen in FIG. 13.

Locking frame 64 is pivoted adjacent its upper edge and is shown in its locking position in FIG. 7 and its rotated, unlocking position in FIG. 11. Locking frame 64 carries a pair of ears 66 and 68 which are in alignment with the slots 60 and 62 when the lock cylinder is pressed in. The relationship of the ears to the slots is best seen in FIG. 13, but ear 68 is shown outside of slot 62 in FIG. 7 and in the slot in FIG. 11.

Figure 8:
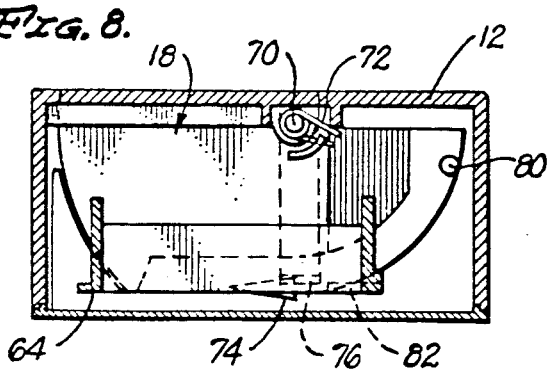
FIG. 8 is a downwardly looking section, as seen generally along line 8—8 of FIG. 6.
Figure 9:
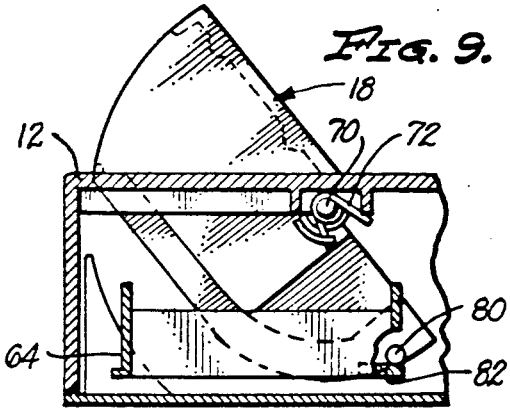
FIG. 9 is similar to FIG. 8, with parts broken away and with the keysafe drawer in the open position.

Drawer 18 is pivoted on pivot pin 70, see FIGS. 8 and 9, and is spring-urged by spring 72 from the closed position shown in FIG. 8 to the open position shown in FIG. 9. The lower part of locking frame 64 carries striker 74 thereon, and latch spring 76 abuts thereagainst when the drawer is in the closed position and the locking frame is in its back, locked position. This abutment is seen in FIG. 6. When the locking frame swings forward from the position of FIG. 7 to the position of FIG. 11, the striker 74 is moved away from latch spring 76 so that the door springs open for access to the key. The swinging forward of the locking frame is indicated by the number "5" in FIGS. 12 and 13. The swinging open of the drawer is indicated by the number "6". The locking frame is urged forward by flat spring 78, seen in FIGS. 7 and 11.

The drawer swings out from its locked position to an intermediate position shown in FIG. 11. In this position, thrust pin 80 engages against the front of flange 82, which extends from the bottom of the locking frame adjacent striker 74. The user grasps the drawer 18 and swings it farther forward. This motion cams the locking plate back toward its locked position. When it reaches its locked position, its ears are withdrawn from the slots 60 and 62, and spring 58 thrusts lock cylinder 26 to the left. This leftward motion holds the locking plate in the rearward, locking position. When the contents of the drawer have been returned to the drawer, the drawer is swung shut. This brings the striker 74 past the latch spring 76, which springs into latching position. The drawer is now locked shut, and the only further steps are those associated with returning the keysafe to its original condition. The programmer 20 cannot be withdrawn without being turned, and it cannot be turned until all the slots 56 are in line with the bar 54. Thus, the steps required to remove the programmer are the steps of returning the combination wheels to the reference position, where all of the actuators 42 are in line at the bottom lying against the lock body wall defining the combination wheel opening. When the slots 56 in the combination wheels are all in line, the programmer can be turned in the counterclockwise direction, as seen in FIG. 12. Once turned, the latches 30 and 32 are released from the programmer opening, the programmer disc is withdrawn to return the keysafe to its original condition. This mechanism, thus, assures that the combination wheels be returned to their reference position before withdrawal of the programmer so that the correct combination is not given away to subsequent viewers.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A keysafe comprising:

a body, a compartment in said body, said compartment having an accessible and an inaccessible position;

said body having programmer-receiving means for receiving a programmer, a programmer configured to be received by said programmer-receiving means;

at least one combination wheel, said combination wheel being movable from a reference position to at least one other position, said combination wheel being associated with said programmer-receiving means so that said programmer can set said programmer-receiving means in a unique position and said combination wheel has a corresponding unique position, said programmer-receiving means being connected to said compartment so that when both said programmer-receiving means and said combination wheel are in their corresponding unique positions, said compartment can be moved from its inaccessible to its accessible position and when either of said programmer-receiving means and said combination wheel is away from said corresponding unique positions, said compartment cannot be moved from its inaccessible position; and means interconnecting said programmer-receiving means and said combination wheel for requiring positioning of said combination wheel in the reference position to permit withdrawal of said programmer from said programmer-receiving means.

2. The keysafe of claim 1 wherein there is a plurality of combination wheels and said interconnection means requires each of said combination wheels to be in the reference position before removal of said programmer.

3. The keysafe of claim 1 wherein said programmer-receiving means is rotatable in said body and an ear is mounted on said programmer-receiving means, interengaging means mounted in said body adjacent said combination wheel, said interengaging means being for cooperating with said combination wheel when said combination wheel is in its reference position, said ear being connected to said interengaging means for permitting rotation of said programmer-receiving means when said combination wheel interengaging means indicates said combination wheel is in its reference position.

4. The keysafe of claim 3 wherein said programmer is configured so that it can be removed from said programmer receiving means only when said interengaging means indicates that said combination wheel is in its reference position.

5. The keysafe of claim 4 wherein there is a plurality of combination wheels and said interengaging means requires each of said combination wheels to be reset to the reference position before removal of said programmer.

6. The keysafe of claim 5 wherein said interengaging means comprises a bar pivotally mounted in said body and a slot in each said combination wheel with said bar pivoting into said slots when said combination wheels are in their reference position when said programmer is rotated to a position where said programmer can be removed from said programmer-receiving means.

7. A keysafe comprising:

a lock body;

a lock cylinder in said lock body, said lock cylinder being configured to receive a programmer, a plurality of tumblers in sid lock cylinder;

a programmer configured to be inserted in said lock cylinder and to uniquely position each of said tumblers with respect to said lock cylinder in accordance with the unique shape of said programmer, said lock cylinder being rotatable in said lock body;

a plurlaity of combination wheels rotatably mounted in said lock body and cooperating with said tumblers so that each said combination wheel has a unique position corresponding to a unique position of an associated tumbler so that when said combination wheels are aeach moved to their unique position corresponding to the unique tumbler position defined by said programmer, acces to said keysafe is achieved, each of said combination wheels having a reference position;

means interengaging said lock cylinder and said combination wheels for permitting withdrawal of said programmer only when all said combination wheels are in the reference position.

8. The keysafe of claim 7 wherein said means comprises physical means on each of said combination wheels and physical abutment means engaging therewith and actuated by rotation of said lock cylinder for requiring said combination wheels to be set in their reference positions to permit rotation of said lock cylinder and to permit removal of said programmer.

9. The keysafe of claim 8 wherein said means is interconnected with said lock cylinder so that rotation of said lock cylinder causes said physical abutment means to interengage with said abutment means.

10. The keysafe of claim 9 wherein said abutment means comprises a slot and a bar.

11. The keysafe of claim 10 wherein said slot is on said combination wheel and said bar is rotatably mounted in said lock body.

12. The keysafe of claim 11 wherein said lock cylinder has an ear thereon interengaging with said bar to move said bar into said slots in said combination wheels when said combination wheels are set in the reference position to permit rotation of said lock cylinder and subsequent removal of said programmer.

13. The keysafe of claim 12 wherein said lock cylinder is also axially movable in said lock body to move said tumblers with respect to said combination wheels to check the related unique position thereof.

14. A keysafe resetting mechanism for a keysafe having a programmer to individually set each of a plurality of tumblers in a lock cylinder and having a plurality of combination wheels settable to positions corresponding to the tumbler positions to permit access to a controlled space, comprising:

a stop on each said combination wheel;

engagement means for positioning with respect to said stops on said combination wheels; and means interconnecting said lock cylinder and said combination wheels for permitting withdrawal of said programmer only when said stops are against said engagement means with said combination wheels in a reference position.

15. The keysafe of claim 14 wherein said engagement means comprises a bar for engagement against said stops.

16. The keysafe of claim 15 wherein said stops comprise notches in said combination wheels.

17. The keysafe of claim 14 wherein said lock cylinder is rotatable from a first position to a second position and rotation of said lock cylinder from said first position to said second position is permitted only when said stop is against said engagement means.

18. The keysafe of claim 17 wherein said engagement means comprises a bar rotatable in said keysafe and said bar is rotated from a position where it is disengaged from said stops to a position where it is engaged with said stop as said lock cylinder is rotated from its first position to its second position.

19. The keysafe of claim 18 wherein said programmer has a notch therein, said notch engaging with a stop when said lock cylinder is in its first position to prohibit removal of said programmer and is free of said stop when said lock cylinder is in its second position to permit removal of said programmer.

20. The keysafe of claim 19 wherein said stops on said combination wheels comprise notches in said combination wheels and said engagement means comprises a bar which can engage in said notches when said combination wheels are in reference position and when said bar is engaged in said notches, said lock cylinder can be rotated from its first position to its second position.

* * * * *